US005662062A

United States Patent [19]

Veverka

[11] Patent Number: 5,662,062

[45] Date of Patent: Sep. 2, 1997

[54] AERODYNAMIC CREW SHELL FAIRING

[76] Inventor: Corey J. Veverka, 2405 Garrett Rd., Drexel Hill, Pa. 19026

[21] Appl. No.: 656,370

[22] Filed: May 31, 1996

[51] Int. Cl.[6] ..... B63B 17/00

[52] U.S. Cl. ..... 114/361

[58] Field of Search ..... 114/343, 347, 114/361

[56] References Cited

U.S. PATENT DOCUMENTS

| | | | |
|---|---|---|---|
| 739,389 | 9/1903 | Castle | 114/361 |
| 2,864,391 | 12/1958 | Stark | 114/361 |
| 3,665,532 | 5/1972 | Simpson | 114/347 |
| 4,957,056 | 9/1990 | Martin | 114/361 |

*Primary Examiner*—Stephen Avila
*Attorney, Agent, or Firm*—Fitzpatrick, Cella, Harper & Scinto

[57] ABSTRACT

A crew shell fairing removably mountable to a crew shell includes an aerodynamic shell and a mounting member for mounting the aerodynamic shell on the crew shell. The aerodynamic shell includes an end surface, a bottom surface, a substantially convex outer surface, and a substantially concave inner surface. The end surface is substantially U-shaped and has an end surface inner edge and an end surface outer edge. The bottom surface is substantially U-shaped and has a bottom surface inner edge and a bottom surface outer edge. The substantially convex outer surface extends from the end surface outer edge towards the bottom surface outer edge. The substantially concave inner surface extends from the end surface inner edge towards the bottom surface inner edge.

18 Claims, 8 Drawing Sheets

AERODYNAMIC CREW SHELL FAIRING

BACKGROUND OF THE INVENTION

1. Field of the Invention

The present invention relates to an aerodynamic fairing for use with a crew shell. More specifically, the present invention relates to a removably mountable aerodynamic fairing for use with a crew racing shell to decrease aerodynamic drag resulting from head winds acting on the crew shell, rowers, and equipment disposed on the crew shell.

2. Description of the Related Art

Crew racing is a highly competitive sport in which races are often won or lost by hundredths of a second. Technological research in the area of crew racing has largely been concentrated in four major areas of racing shell technology. These areas involve hull shape, hull materials, oar design, and blade design. That research seeks to minimize hydrodynamic drag that acts on the crew shell and make crew equipment stronger, stiffer and lighter. Efforts also are constantly being made to improve the technique and conditioning of the rowers. The result of such research has been dramatically improved racing times.

However, one area of crew racing shell research that has heretofore been largely ignored is that involving the aerodynamic forces that act upon the crew racing shell. Particularly when a crew shell, its rowers and equipment mounted on the crew shell are subjected to head winds (including head winds with a crosswind component), a large amount of aerodynamic drag develops and acts to decrease the efficiency and velocity of the crew shell. To date, such forces have not been considered important because aerodynamic drag on the crew shell were deemed a relatively small source of inefficiency contributing to increased racing times. However, as technology research in the traditional areas described above approaches a point of diminishing returns, research and design improvements directed to reducing aerodynamic drag have been become increasingly attractive.

SUMMARY OF THE INVENTION

Accordingly, it is a principal object of the present invention to provide a crew shell fairing for reducing aerodynamic drag that acts on the crew shell.

This object is achieved by the present invention which, in one aspect, provides a crew shell fairing removably mountable onto a crew shell, the crew shell fairing comprising an aerodynamic shell and attaching means for removably attaching the aerodynamic shell to a top surface of the crew shell.

In another aspect, the present invention relates to a crew shell fairing removably mountable onto a crew shell, the crew shell fairing comprising an end surface and a bottom surface disposed substantially perpendicular to the end surface. The end surface is substantially U-shaped and has an end surface inner edge and an end surface outer edge. The bottom surface is substantially U-shaped and has a bottom surface inner edge and a bottom surface outer edge. A substantially convex outer surface extends from the end surface outer edge to the bottom surface outer edge. A substantially concave inner surface extends from the end surface inner edge to the bottom surface inner edge. The crew shell fairing further comprises at least one mounting member disposed on the bottom surface and removably connected to the crew shell when the crew shell fairing is mounted on the crew shell.

In yet another aspect, the present invention relates to a crew shell fairing removably mountable onto a crew shell, the crew shell fairing comprising an end surface and a bottom surface. The end surface is substantially U-shaped and has an end surface inner edge and an end surface outer edge. The bottom surface is substantially U-shaped and has a bottom surface inner edge and a bottom surface outer edge. The crew shell fairing further comprises an aerodynamic shell having a substantially convex outer surface extending between the end surface outer edge and the bottom surface outer edge, a substantially concave inner surface extending between the end surface inner edge and the bottom surface inner edge, and at least one lip surface that extends from at least one of the end surface outer edge and the bottom surface outer edge to the substantially convex outer surface. The crew shell fairing further comprises at least one mounting member disposed on the bottom surface and removably connected to the crew shell when the crew shell fairing is mounted on the crew shell.

These and other objects, aspects, features, and advantages of the present invention will become apparent from the following detailed description of the preferred embodiments, taken in conjunction with the drawings.

DETAILED DESCRIPTION OF THE PREFERRED EMBODIMENTS

The crew shell fairing of the present invention is removably mountable onto a crew shell to decrease aerodynamic drag caused by head winds acting on the crew shell, the rowers, and various equipment mounted to or usable with the crew shell.

Figure 1:
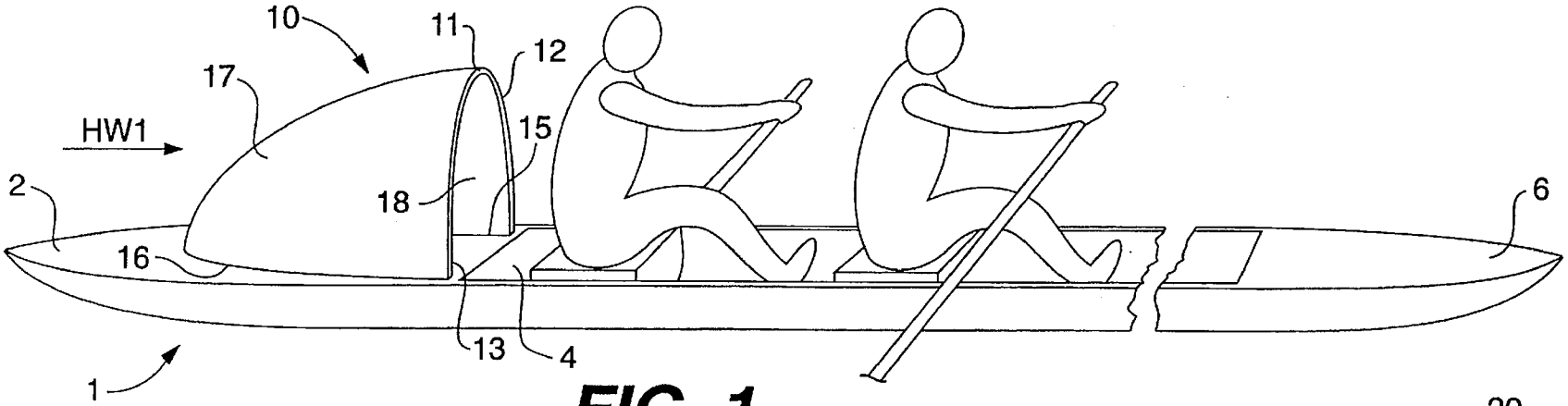
FIG. 1 is a perspective view of a crew shell fairing according to a first embodiment of the present invention.

As depicted in FIG. 1, the crew shell fairing 10 includes an aerodynamic shell having a concavo-convex surface. At one end of the crew shell fairing 10 is an end surface 11 that is substantially U-shaped. The end surface 11 includes an end surface inner edge 13 and an end surface outer edge 12. The crew shell fairing also includes a bottom surface 14 (FIG. 5), which also is substantially U-shaped. The bottom surface includes a bottom surface inner edge 15 and a bottom surface outer edge 16. The bottom surface 14 and the end surface 11 are substantially perpendicular to each other with both ends of the U-shape of each of these surfaces being co-terminal.

The body of the crew shell fairing is an aerodynamic shell that extends from the end surface 11 to the bottom surface 14. More specifically, a convex outer surface 17 extends from the end surface outer edge 12 to the bottom surface outer edge 16. Similarly, a concave inner surface 18 of the crew shell fairing extends from the end surface inner edge 13 to the bottom surface inner edge 15. As depicted in FIG. 1, the convex outer surface 17 and the concave inner surface 18 extend from the end surface 11 to the bottom surface 14 by sweeping through an angle of Θ, depicted in FIG. 2. The angle Θ may be any desired value, but is approximately 90 degrees in FIG. 2.

Figure 3:
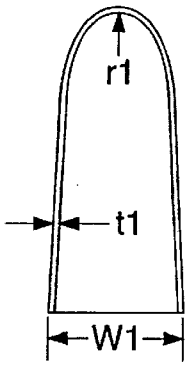
FIG. 3 is a rear elevational view of the crew shell fairing depicted in FIG. 1.
Figure 2:
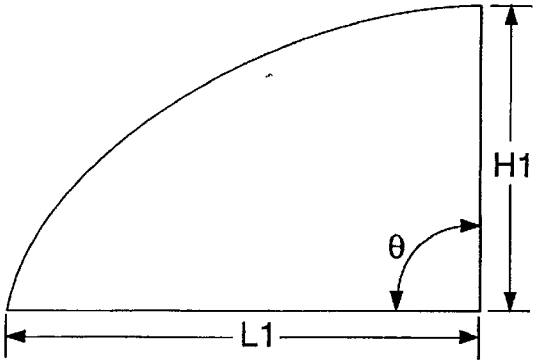
FIG. 2 is a side elevational view of the crew shell fairing depicted in FIG. 1.

As also depicted in FIG. 2, the crew shell fairing has a maximum height H1 at the end surface 11 and a maximum length L1 at the bottom surface 14. As depicted in FIG. 3, the crew shell fairing has a maximum width W1 at the position where the end points of the U-shape of the end surface 11 meet the end points of the U-shape of the bottom surface 14. The crew shell fairing has a thickness t1, which may be variable or substantially constant. The closed end of the U-shape of the end surface 11 has a radius of curvature r1 (FIG. 3), while the closed end of the U-shape of the bottom surface 14 has a radius of curvature of r2 (FIG. 5). The crew shell fairing may be effectively employed on crew shells designed for any number of rowers.

In a first embodiment of the present invention, depicted in FIGS. 1–6, the maximum height H1 of the crew shell fairing 10 is approximately two feet, while the maximum length L1 of the crew shell fairing 10 is approximately three feet. The maximum width W1 is approximately 13 inches. The radius of curvature r1 of the closed end of the U-shape of the end surface 11 is approximately 6 inches, while the closed end of the U-shape of the bottom surface 14 has a radius of curvature r2 of approximately 3.5 inches. If a cross section of the crew shell fairing 10 is taken in a direction perpendicular to the bottom surface 14 of the crew shell fairing 10, the width of the cross section will monotonically decrease from the bottom surface 14 of the cross section towards an upper surface of the aerodynamic shell. The "footprint" of the crew shell fairing 10 will have a width that initially remains substantially constant as measured near the open end of the U-shape of the bottom surface 14, and then monotonically decreases towards the closed end of the U-shape of the bottom surface 14. Of course, the U-shape of the end surface 11 and the U-shape of the bottom surface 14 may be any other shape that facilitates the shaping of the aerodynamic shell such that desirable characteristics for the crew shell fairing are realized.

Figure 7:
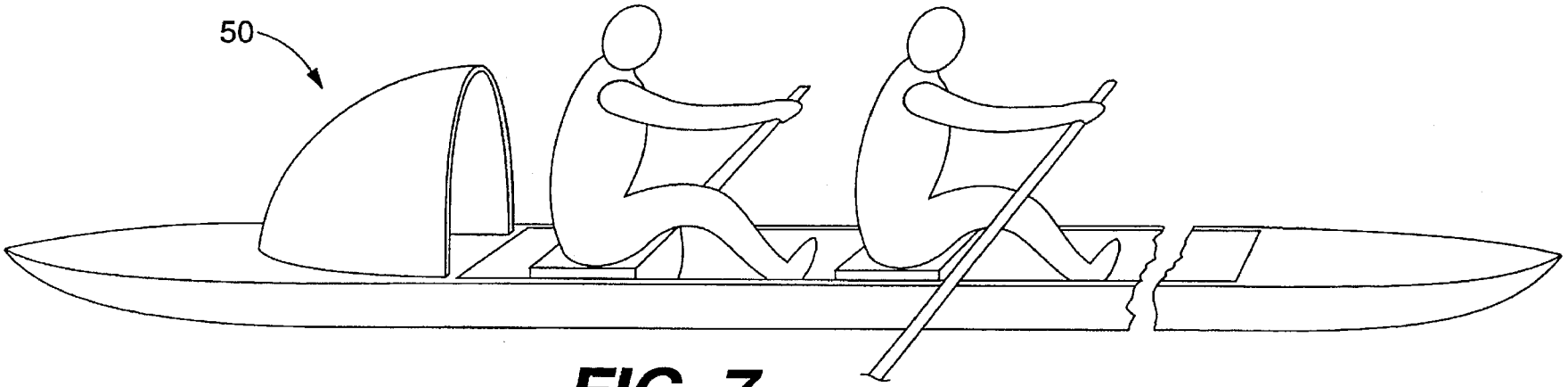
FIG. 7 is a perspective view of a crew shell fairing according to a second embodiment of the present invention.
Figure 8:
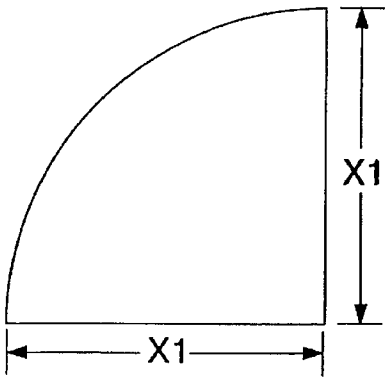
FIG. 8 is a side elevational view of the crew shell fairing depicted in FIG. 7.

In a second embodiment of the present invention, depicted in FIGS. 7 and 8, the crew shell fairing 50 has a maximum height X1 that is substantially equal to a maximum length X1 of the crew shell fairing 50. Such symmetry in the crew shell fairing 50 enables certain advantages to be realized, such as simplified manufacturability.

Figure 9:
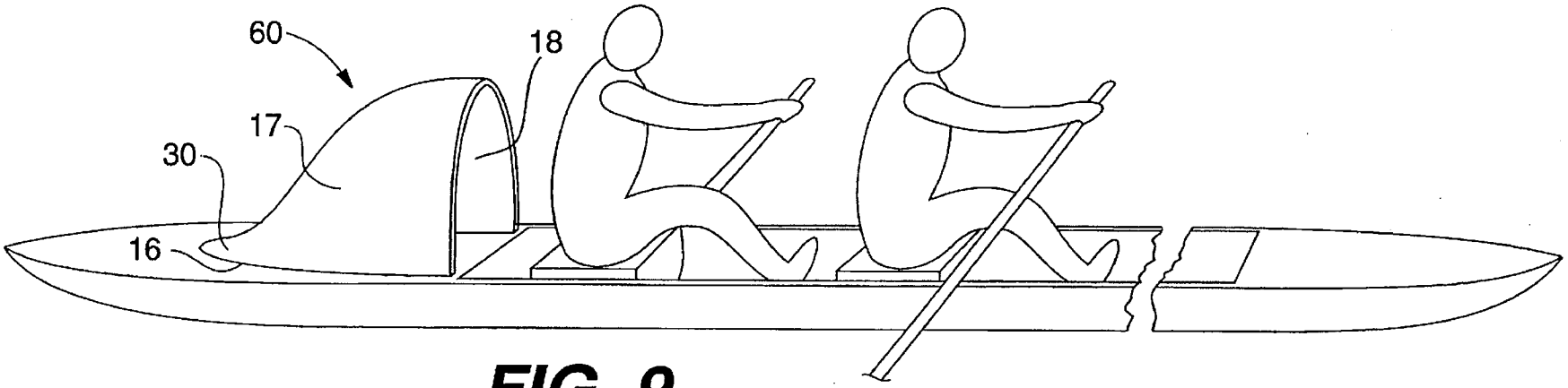
FIG. 9 is a perspective view of a crew shell fairing according to a third embodiment of the present invention.
Figure 10:
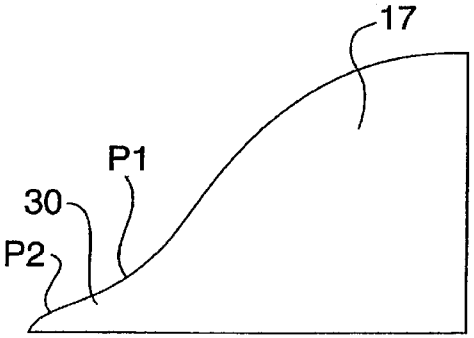
FIG. 10 is a side elevational view of the crew shell fairing depicted in FIG. 9.

In a third embodiment of the present invention, depicted in FIGS. 9 and 10, the crew shell fairing 60 includes a lip 30 to improve the aerodynamic characteristics of the crew shell fairing 60. In this embodiment, as the convex outer surface 17 and the concave inner surface 18 approach the bottom surface 14, they flare out towards the bottom surface 14 to create the lip 30. The lip 30 is effective to eliminate an air flow stagnation zone that otherwise may occur at the interface between the foremost portion of the mounted crew shell fairing and the crew shell. Such a stagnation zone causes additional pressure drag forces that reduce the efficiency and the velocity of the crew racing shell.

As depicted in FIG. 10, the outer surface 17 may include an inflection point P1 at which the outer surface 17 transitions from a convex shape to a concave shape. The lip 30 may also include an inflection point P2 at which the lip 30 transitions from a concave shape to a convex shape. Of course, the lip 30 is not required to have such an inflection point P2. Moreover, the lip 30 may be formed by angling a surface that extends from a locus of inflection points corresponding to, and including, the point P1 to the bottom surface outer edge 16. The inner surface 18 of this embodiment may follow the contour of the outer surface 17 or, alternatively, the inner surface 18 may be entirely substantially convex. In such a case, the thickness of the crew shell fairing will vary depending at which part of the crew shell fairing the thickness is measured.

Figure 11:
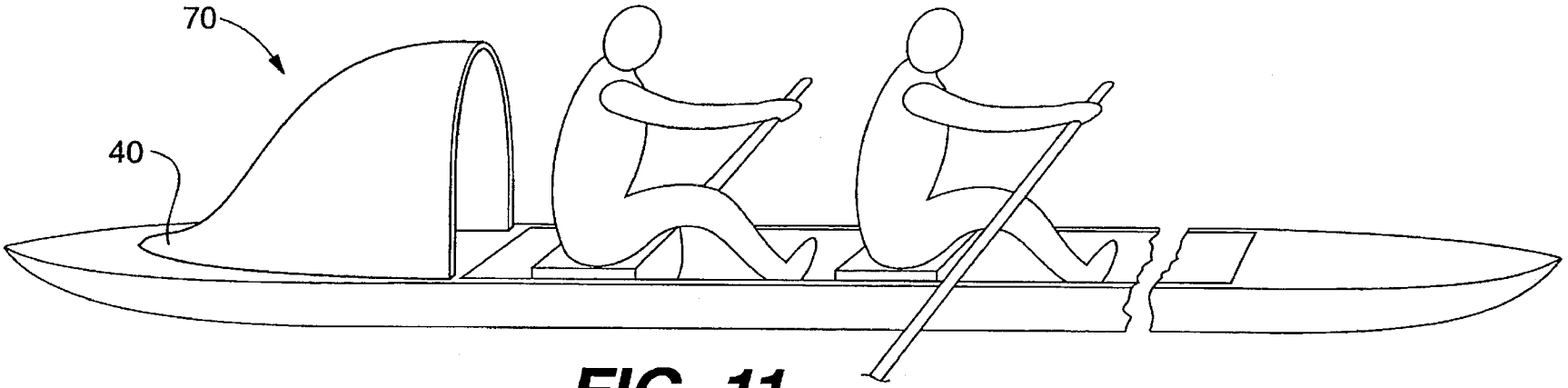
FIG. 11 is a perspective view of a crew shell fairing according to a fourth embodiment of the present invention.

A fourth embodiment of the present invention is depicted in FIG. 11. Although this embodiment includes features similar to those of the third embodiment, the crew shell fairing 70 of the fourth embodiment includes a more pronounced lip 40 that provides for a smoother transition of airflow between the crew shell surface and the convex outer surface of the crew shell fairing 70. The fourth embodiment further differs from the third embodiment in that it has an increased maximum height and an increased maximum length. The increased maximum length further facilitates smoother airflow transition, while the increased height of the crew shell fairing 70 enables the fairing to more effectively direct airflow over the rowers.

Figure 12:
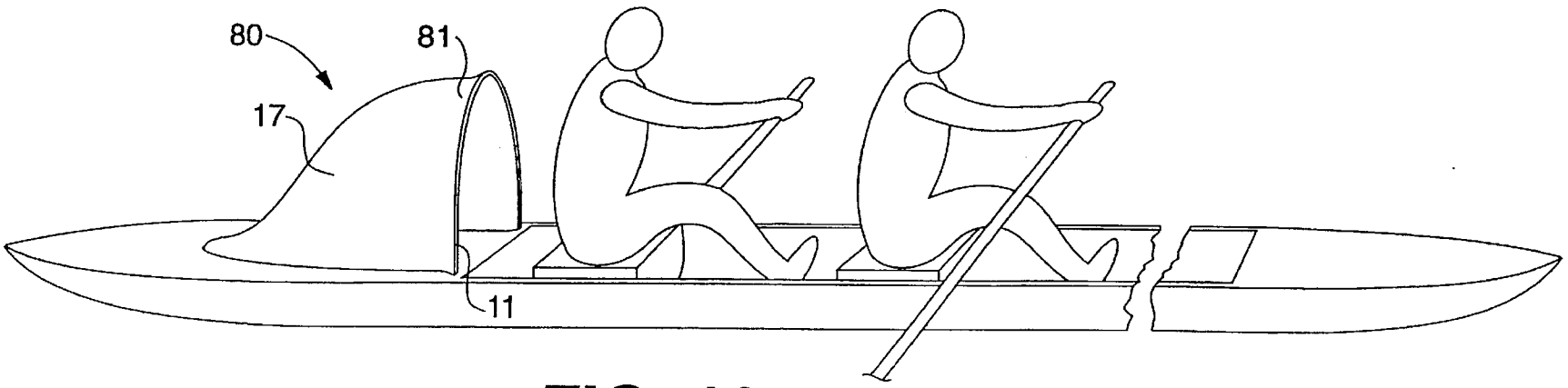
FIG. 12 is a perspective view of a crew shell fairing according to a fifth embodiment of the present invention.

A fifth embodiment of the present invention is depicted in FIG. 12. As is evident from FIG. 12, the crew shell fairing 80 may also include a lip 81 extending between the end surface 11 and the convex outer surface 17. The lip 81 is effective to guide the airflow in a path directed away from even peripheral portions of the rowers.

Figure 13:
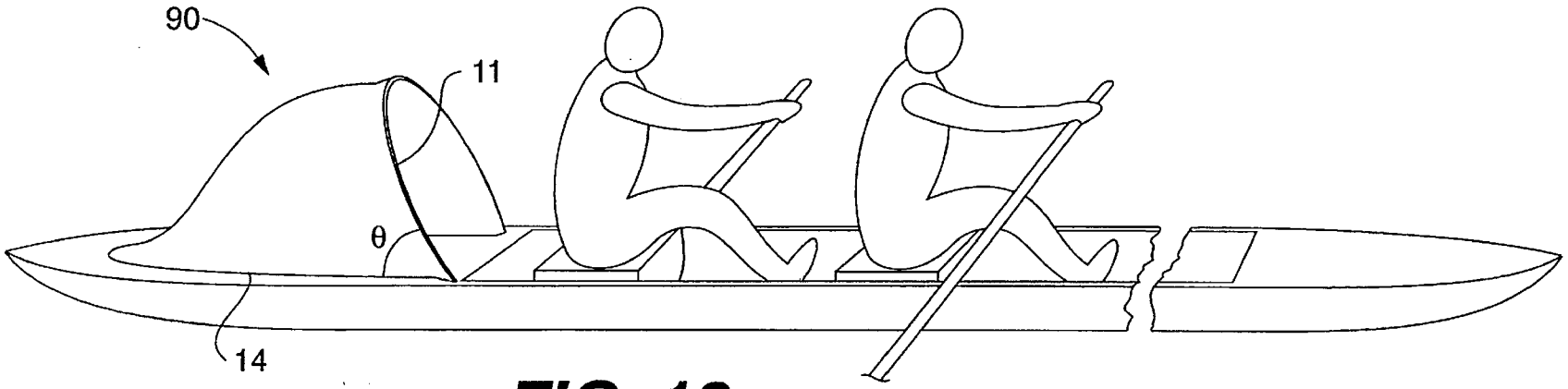
FIG. 13 is a perspective view of a crew shell fairing according to a sixth embodiment of the present invention.

A sixth embodiment of the present invention is depicted in FIG. 13. The crew shell faring 90 of this embodiment is similar to the fifth embodiment of the present invention, however, the angle Θ between the end surface 11 and the bottom surface 14 is less than 90 degrees. The resulting slope of the end surface 11 facilitates the freedom of movement of the bowman. For example, the sloped surface lessens the likelihood that the crew shell fairing 90 will interfere with the rowing motion of the bowman.

Figure 14:
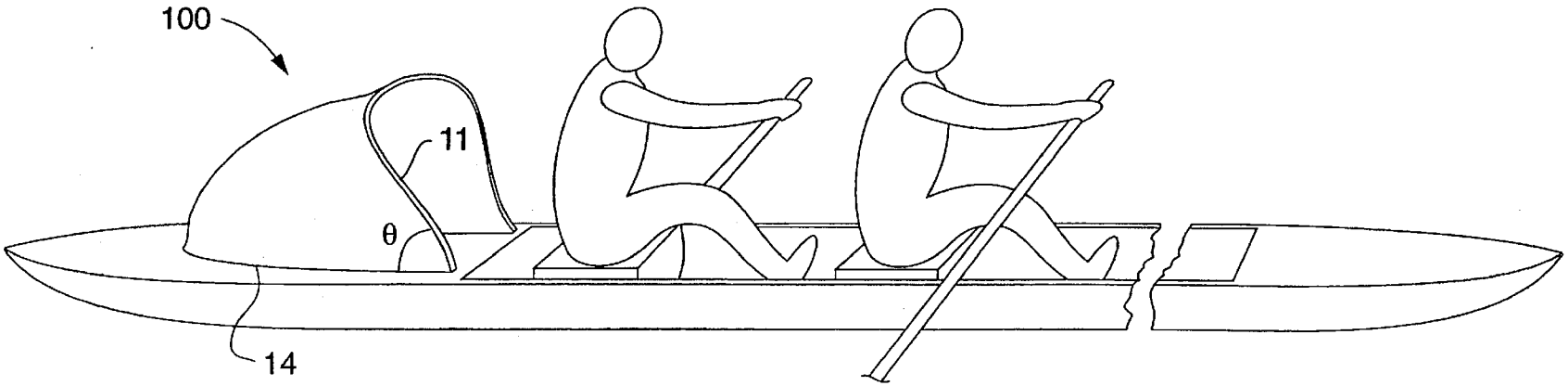
FIG. 14 is a perspective view of a crew shell fairing according to a seventh embodiment of the present invention.

A seventh embodiment of the present invention is depicted in FIG. 14. In the seventh embodiment, the end surface 11 of the crew shell faring 100 has a bulb shape in which the maximum width of the end surface 11 occurs substantially adjacent to a top surface of the aerodynamic shell. Such a bulb shape more closely approximates the silhouette of the rowers.

Figure 15:
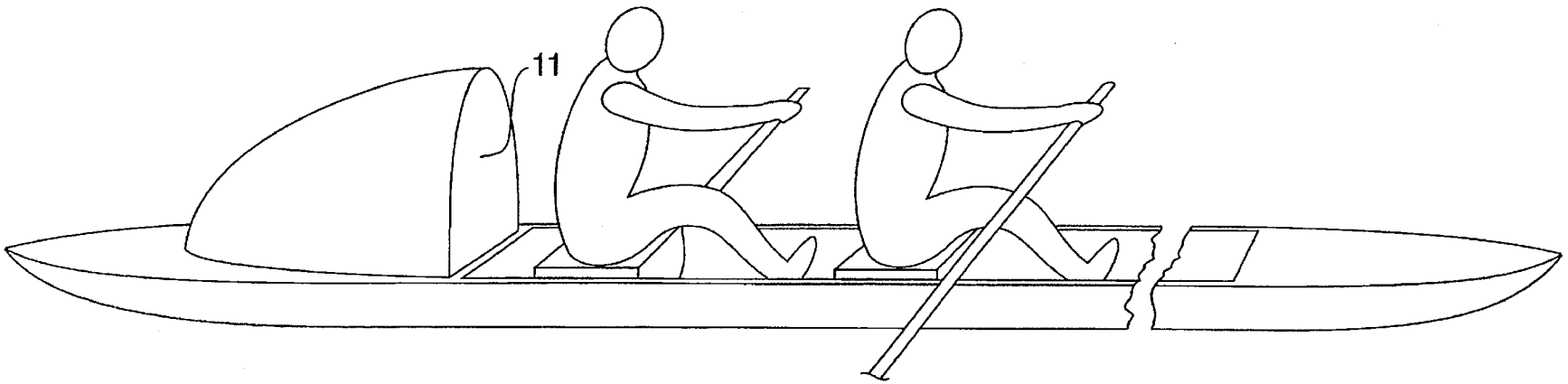
FIG. 15 is a view of the crew shell fairing depicted in FIG. 1 showing a closed end surface.

In each of the foregoing embodiments, the end surface 11 has been depicted as an open surface. The present invention, however, is not limited in this manner and the end surface 11 of any of the foregoing embodiments may be closed, as depicted, for example, in FIG. 15. Moreover, the various features attributed to certain of the foregoing embodiments may be incorporated in other embodiments, as desired.

Although the foregoing description includes specification of certain dimensions of the crew shell fairing, such dimensions are provided for illustrative purposes only and may be modified in accordance with the configuration of a particular crew shell to which the crew shell fairing will be removably mounted, and in accordance with the particular effects that are desired.

The crew shell fairing of the present invention is preferably made as a single piece of molded material, such as a fiberglass epoxy resin. Other materials may also be used, such as natural and synthetic resins, plastics, and the like. Alternatively, the crew shell fairing of the present invention may be constructed of a frame covered by a skin to achieve the desired shape.

In any case, the crew shell fairing is constructed to be lightweight yet strong, and stiff enough to sustain forces generated by the strong head winds encountered by the crew shell in racing conditions. The weight of the crew shell fairing is preferably less than five pounds and more preferably less than three pounds. The crew shell fairing should also be made of a waterproof material and have an outer surface finish having desirable aerodynamic characteristics. For example, the surface finish may be substantially smooth to promote laminar airflow over the crew shell fairing to reduce aerodynamic drag. It may also be desirable to provide a surface finish that is rough or dimpled, at least in certain areas, so as to help prevent separation of airflow from the surface of the crew shell fairing.

Depending upon particular race conditions, it may be desirable to configure the crew shell with the crew shell fairing or without the crew shell fairing. Accordingly, the present invention allows for the crew shell fairing to be easily attached and easily detached from the crew shell. The attachment between the crew shell fairing and the crew shell must be such that the crew shell fairing remains securely attached even when subjected to forces generated by severe head winds and/or crosswinds. In a preferable embodiment, such attachment may be achieved by a hook-and-loop-type fastener, such as an industrial strength Velcro® fastener system, or by a fastener having an alternative interlocking structure, such as a Dual-Lock® fastener system.

Figure 5A:
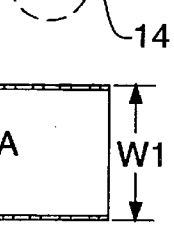
FIG. 5A is an enlarged view of a portion of the crew shell fairing depicted in FIG. 5.
Figure 5:
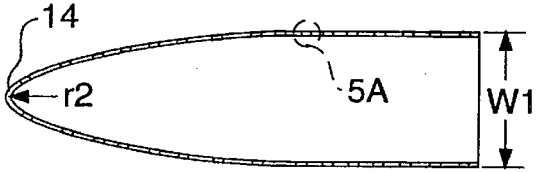
FIG. 5 is a bottom view of the crew shell fairing depicted in FIG. 1.
Figure 6:
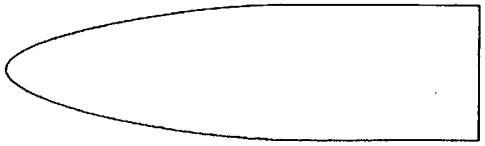
FIG. 6 is a top view of the crew shell fairing depicted in FIG. 1.
Figure 4:
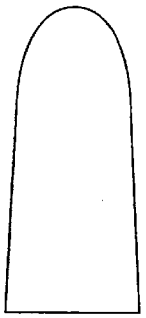
FIG. 4 is a front elevational view of the crew shell fairing depicted in FIG. 1.

As depicted in FIG. 5A, for example, the fastener system 20 may be attached to the bottom surface 14 of the crew shell fairing 10. The fastener system may be in the form of patches spaced along the bottom surface 14 or, alternatively, in the form of a single strip disposed continuously along the bottom surface 14. The mating pieces of the fastener system 20 are attached to a top surface of the crew shell at a position between the bowman position and the bow of the crew shell. The attaching or mounting device of the fairing is not limited to these fastener systems, but may be any sort of attaching or mounting device that allows the crew shell fairing to be easily attachable to and easily detachable from the crew shell, and is capable of securely attaching the crew shell fairing even when subjected to significant aerodynamic and other forces. The attaching or mounting device is preferably lightweight and resistant to water and corrosion.

As depicted in FIG. 1, for example, the crew shell fairing 10 is positioned on the crew shell 1 between the bow 2 of the crew shell 1 and the bowman position 4. Further, the end surface 11 of the crew shell fairing 10 is disposed towards the direction of the stern 6 of the crew shell 1, while the closed end of the U-shape of the bottom surface 14 of the crew shell fairing 10 is disposed in the direction of the bow 2 of the crew shell 1. In this manner, when the crew shell 1 moves in the forward direction (i.e., the direction of the bow 2), a head wind HW1 in the direction of the stern 6 is deflected by the crew shell fairing 10. Further, the crew shell fairing 10 may also deflect winds having a component in the crosswind direction.

By providing an aerodynamic crew shell fairing that is lightweight, strong, stiff, waterproof, easily attachable and easily detachable, and that has an aerodynamically desirable surface finish, the present invention is effective in reducing aerodynamic drag caused by head winds acting upon the crew shell, the rowers, and various equipment on the crew shell. The present invention thus is effective in increasing crew shell velocities and reducing racing times.

In designing the crew shell fairing of the present invention, detailed analyses were conducted using both wind-tunnel testing and computational fluid flow analyses. The following assumptions were made in order to simplify the analyses:

1) In still air, the aerodynamic drag is considered to be between 5 and 15 percent of the total drag;
2) Drag coefficients are constant in the speed range of interest;
3) Hydrodynamic drag varies with the square of the boat velocity relative to the water;
4) Aerodynamic drag varies with the square of the difference between the velocity of the boat and the wind velocity;
5) The addition of the crew shell fairing will not cause an increase in hydrodynamic drag due to additional weight or induced negative lift;
6) The effect of waves generated by a head wind is ignored;
7) The head wind will be steady and parallel to the direction of motion of the crew shell; and
8) The aerodynamic drag due to the oars and rigging is ignored.

Wind-Tunnel Testing

A crew shell model of approximately 1/16 scale, simulating the portion of the shell that is above the water, was constructed out of pinewood. Models of eight rowers and a coxswain were constructed out of pinewood and balsa wood and attached to the crew shell model. The crew shell model was suspended above a Plexiglas® plate simulating the water surface. The Plexiglas® plate was stiffened by attaching an aluminum plate to its bottom surface. Two bolts for the crew shell were passed through a slot in the Plexiglas® plate to support the model. The bolts were connected to a rigid frame that was rotational about an axle. The frame consisted of a one inch square box-beam welded to the axle. At each end of the box-beam, beams were provided to support a main bar. The supporting bolts were held on the main bar. The mounting apparatus for the model was made adjustable so as to enable balancing of the frame. A knife edge was added to the front of the Plexiglas® plate to reduce airflow instability.

The foregoing configuration was used to conduct wind-tunnel tests on four different models. The variable from one test to the next involved the crew shell fairing. The first test was run with no fairing, the second test was run with a fairing having a shape such as described in reference to the second embodiment of the present invention, the third test was run with a fairing having a shape corresponding to the third embodiment of the present invention, and the fourth test was run with a fairing having a shape corresponding to the fourth embodiment of the present invention.

After calibrating the test equipment, the wind tunnel was brought up to speed with the control vents closed. As the control vents were gradually opened, readings for pressure differences to obtain free stream velocity and readings for force on the boat were taken at 10 percent intervals of the full-open position. In this manner, the wind tunnel was opened to 50 percent, was stepped back down to 0 percent, and the process was repeated.

Figure 16:
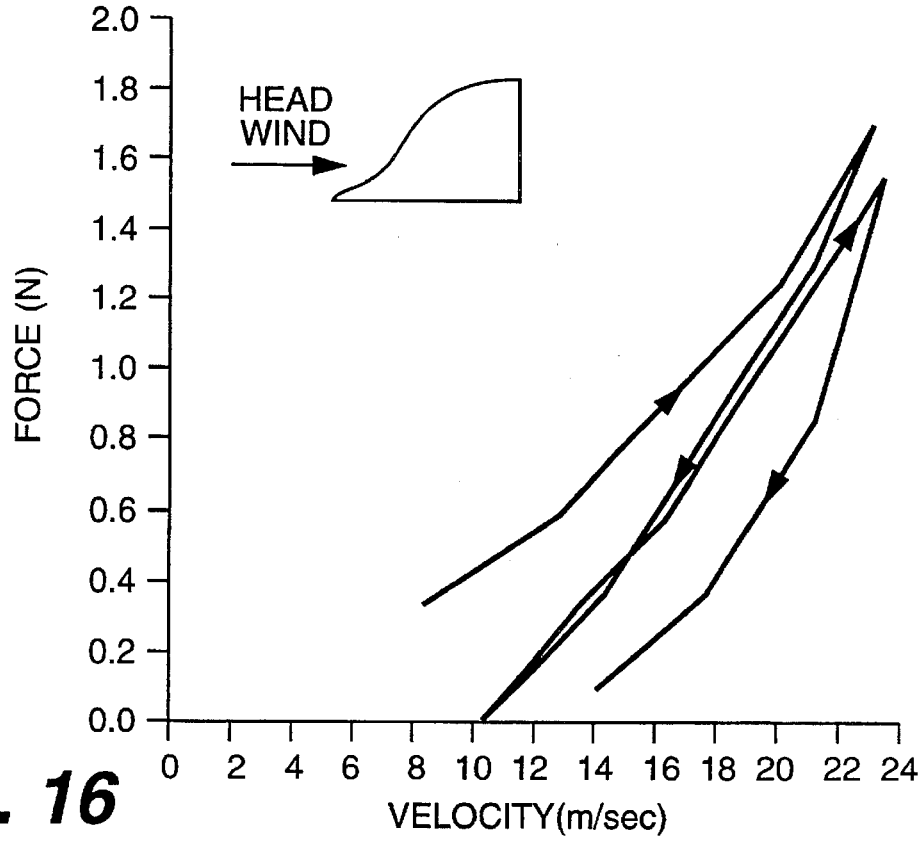
FIG. 16 is a graph of raw wind-tunnel data for a crew shell fairing.

Upon completion of this testing for a particular configuration, the model was altered by changing the crew shell fairing and the test was repeated. For each of the fairing shapes corresponding to embodiments 2–4 of the present invention, duplicate test runs were made. FIG. 16 depicts the raw data for the wind-tunnel test of the fairing having a shape corresponding to the third embodiment of the present invention. It was observed that during a particular test run, data values obtained for force would gradually decrease. This drift in the data was assumed to be linear, and a linear correction factor was added to each data point. It is believed that the drift can be attributed to inherent characteristics of the strain gauges, used for determining the force on the boat, and/or inherent characteristics of the materials used for mounting the test apparatus.

Figure 17:
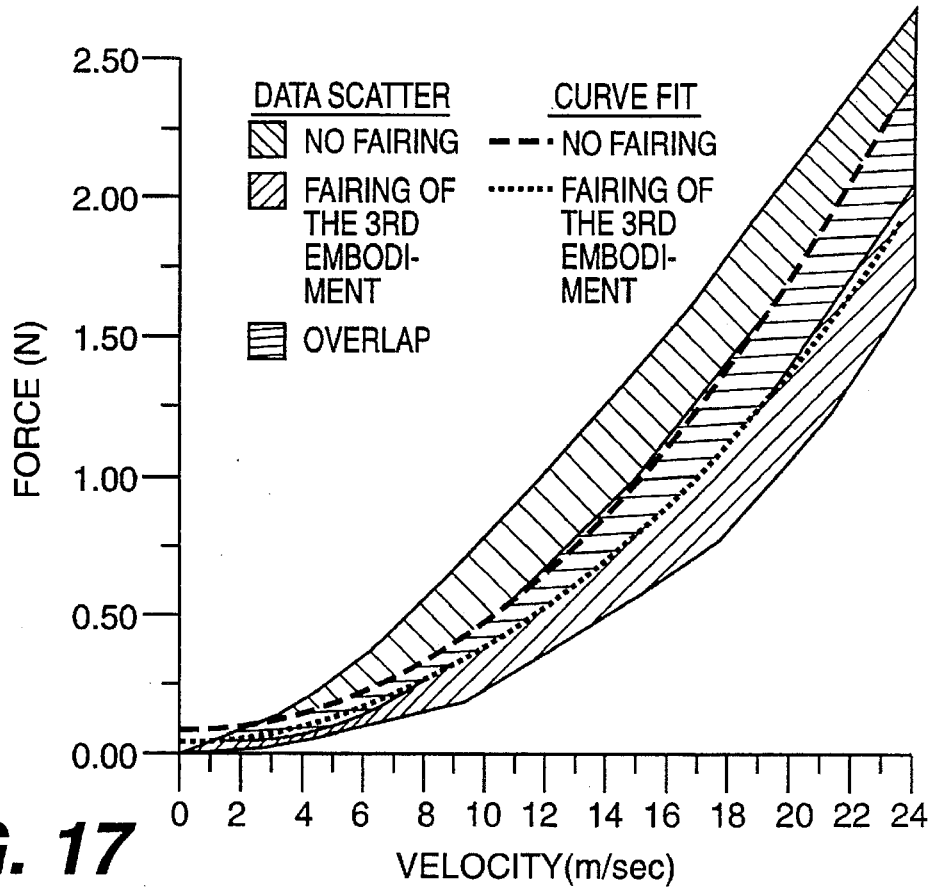
FIG. 17 is a graph showing comparative wind-tunnel testing results for a model having no crew shell fairing and a model having a crew shell fairing.

As expected, the model with no crew shell fairing produced the greatest drag of the tested configurations. The best results were obtained with the fairing having a shape corresponding to the third embodiment of the present invention. The results of the wind-tunnel analysis comparing the model without a fairing with the model having the most effective fairing (corresponding to the third embodiment discussed above) are depicted in FIG. 17.

Computational Fluid Flow Analysis

A computational fluid flow analysis was conducted using a two-dimensional model of the crew shell, crew members, and the crew shell fairing. These items were modeled by dividing the various elements into rectangular cells, with small cells being used toward the bow of the crew shell, and increasingly larger cells being used between the fairing and the bowman. The cell size remained constant from the position of the bowman to the last rower position. Larger cells were expanded 9.86 m upstream and 17.1 m downstream of the crew shell, and 10.0 m above the rowers, to ensure that boundary effects would not influence the test results.

The overall boat length modeled was 17.1 m from bow to stern and the boat height was 0.2 m. The height of the rowers was set at 0.9 m each, and the width of the rowers was set at 0.2 m. The coxswain was modeled with a height of 0.6 m and a width of 0.3 m. Standard values for atmospheric temperature and pressure were used in the analysis.

This model was tested with assumed head winds of 3, 6, and 9 m/s. The overall pressure drag force was calculated by multiplying the pressure on the vertical faces of the crew shell and rowers by their respective frontal areas, assuming a unit depth. The resulting forces were summed to determine an overall drag force. Three fairing shapes corresponding to the second through fourth embodiments of the present invention were modeled for the purposes of computational fluid flow analysis. The results of the analysis conducted in accordance with the foregoing are presented in Table 1.

TABLE 1

| Head Wind Velocity (m/s) | DRAG FORCE (N) No Fairing | Fairing of 2nd Embodiment | Fairing of 3rd Embodiment | Fairing of 4th Embodiment |
|---|---|---|---|---|
| 9 | 514.2 | 491 | 443.7 | 476.4 |
| 6 | 212.9 | 210.7 | 197.5 | 212.3 |
| 3 | 52.09 | 52.9 | 49.7 | 57.7 |

Drag Coefficients $c_d$ for each of the testing configurations were calculated and are tabulated in Table 2. In calculating the drag coefficients, only the frontal area of the bowman or fairing (as the case may be) and the bow of the shell were considered. As indicated by the values of the absolute drag coefficients in Table 2, the drag coefficient values were high as a result of using two-dimensional models. This can be attributed to the fact that two-dimensional models do not take into account air flow around the rowers or the crew shell fairing. Consequently, the absolute drag coefficients have been normalized with respect to the model with no fairing to more easily interpret the test results. These normalized drag coefficients are also presented in Table 2. As is evident from this data, the fairing having a shape corresponding to the third embodiment of the present invention had the lowest coefficient of drag.

TABLE 2

| | DRAG COEFFICIENTS No Fairing | Fairing of 2nd Embodiment | Fairing of 3rd Embodiment | Fairing of 4th Embodiment |
|---|---|---|---|---|
| Absolute $C_d$ | 8.64 | 8.25 | 7.44 | 7.97 |
| Relative $C_d$ | 1 | 0.95 | 0.86 | 0.92 |

The addition of a crew shell fairing on the crew shell causes a negative lift to be generated when the fairing is subjected to a head wind. For the fairing corresponding to the third embodiment of the present invention, this negative lift was estimated to be equivalent to a force of 1.71N in a head wind of 6 m/s. In comparison to the weight of the crew shell, this additional force is negligible.

Figure 18A:
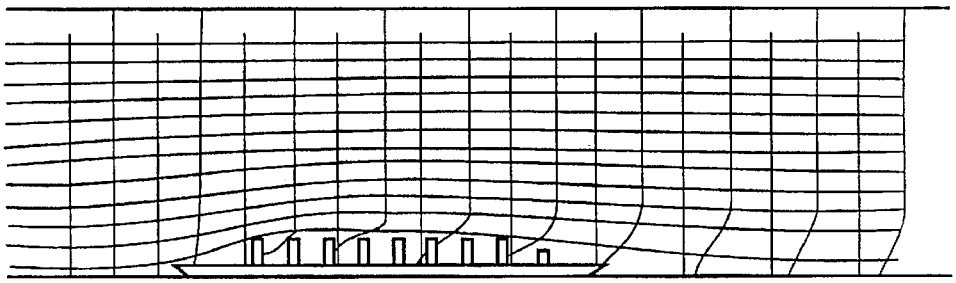
FIGS. 18A and 18B illustrate streamlines and u-velocity profiles calculated using computational fluid flow analysis.
Figure 18B:
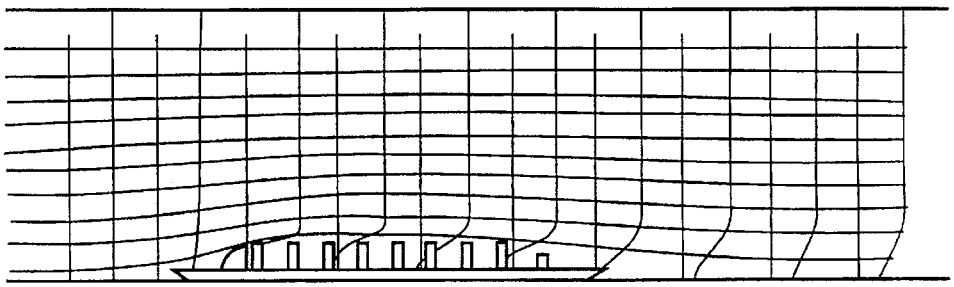
Figure 19A:
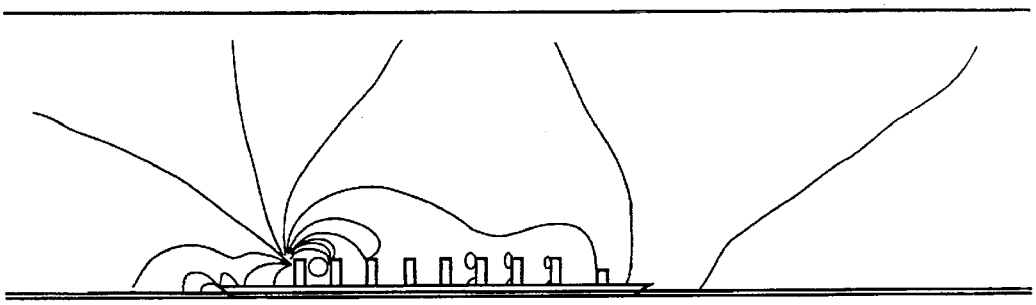
FIGS. 19A and 19B illustrate pressure contours calculated using computational fluid flow analysis.
Figure 19B:
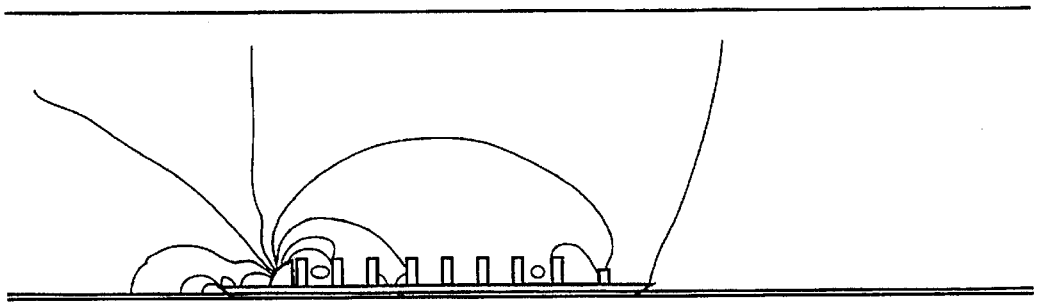

Other results of the computational fluid flow analysis are presented in FIGS. 18A, 18B, 19A, and 19B. FIGS. 18A and 18B depict plots of the stream function contours and u-velocity profiles for the model having no fairing, and for the model having a fairing corresponding to the third embodiment of the present invention, respectively. FIGS. 19A and 19B depict pressure contour plots for the model having no fairing, and for the model having a fairing corresponding to the third embodiment, respectively.

The results of the wind-tunnel analysis and the computational fluid flow analysis were in agreement that the fairing corresponding to the third embodiment of the present invention had the lowest drag coefficient. Relative reductions in drag with this particular fairing were determined to be 23 percent for the wind-tunnel model, and 14 percent for the computational fluid flow model. These results are summarized in Table 3.

TABLE 3

| | DRAG COEFFICIENTS | | | |
|---|---|---|---|---|
| | No Fairing | | Fairing of 3rd Embodiment | |
| | Absolute | Relative | Absolute | Relative |
| Wind-Tunnel Model | 4.78 | 1 | 3.73 | 0.78 |
| Fluid Flow Model (Head Wind Velocity = 9 m/s) | 8.64 | 1 | 7.44 | 0.86 |

On a 2,000 m straight course, such as that used in Olympic racing, aerodynamic improvements on the order of 14 to 23 percent, such as those shown in Table 3, may produce improvements in racing times on the order of 5 seconds. Such improvement is dramatic when it is considered that races are often won or lost by time differences on the order of hundredths of a second.

While the present invention has been described with respect to what is presently considered to be the preferred embodiments, the present invention is not limited to the disclosed embodiments. Rather, the present invention covers various modifications and equivalent arrangements included within the spirit and scope of the appended claims. The scope of the appended claims is to be accorded the broadest interpretation so as to encompass all such modifications and equivalent structures and functions.

What is claimed is:

1. A crew shell fairing removably mountable onto a crew shell, said crew shell fairing comprising:

a substantially U-shaped end surface having an end surface inner edge and an end surface outer edge;

a substantially U-shaped bottom surface having a bottom surface inner edge and a bottom surface outer edge;

an aerodynamic shell having a substantially convex outer surface extending between said end surface outer edge and said bottom surface outer edge, a substantially concave inner surface extending between said end surface inner edge and said bottom surface inner edge, and at least one lip surface that extends from at least one of said end surface outer edge and said bottom surface outer edge to said substantially convex outer surface; and at least one mounting member disposed on said bottom surface and removably connected to the crew shell when said crew shell fairing is mounted on the crew shell, wherein an angle between said end surface and said bottom surface is less than 90 degrees, and wherein said end surface is wider adjacent a closed end of the U-shape of said end surface than at an open end of the U-shape of said end surface.

2. A crew shell fairing according to claim 1, wherein said end surface, said bottom surface, and said aerodynamic shell are formed as a single molded piece made from at least one of a natural resin material, a synthetic resin material, and a plastic material.

3. A crew shell fairing according to claim 1, wherein said at least one mounting member is one of a Velcro® fastener and a Dual-Lock® fastener, which is connectable with corresponding mating pieces attached to a top surface of the crew shell.

4. A crew shell fairing according to claim 1, wherein, when said crew shell fairing is mounted on the crew shell, said crew shell fairing is disposed on a top surface of the crew shell between a bow of the crew shell and a bowman position of the crew shell with said end surface being disposed towards a stern of the crew shell, and a closed end of said U-shaped bottom surface being disposed towards the bow of the crew shell.

5. A crew shell fairing according to claim 1, wherein said end surface is one of a substantially open surface and a closed surface.

6. A crew shell fairing according to claim 1, wherein said aerodynamic shell sweeps through said angle between said end surface and said bottom surface.

7. A crew shell fairing removably mountable onto a crew shell, said crew shell fairing comprising:

a substantially U-shaped end surface having an end surface outer edge;

a substantially U-shaped bottom surface having a bottom surface outer edge;

an aerodynamic shell having a substantially convex outer surface extending between said end surface outer edge and said bottom surface outer edge, and at least one lip surface that extends from at least one of said end surface outer edge and said bottom surface outer edge to said substantially convex outer surface; and at least one mounting member disposed on said bottom surface and removably connected to the crew shell when said crew shell fairing is mounted on the crew shell, wherein an angle between said end surface and said bottom surface is less than 90 degrees, and wherein said end surface is wider adjacent a closed end of the U-shape of said end surface than at an open end of the U-shape of said end surface.

8. A crew shell fairing according to claim 7, wherein said end surface, said bottom surface, and said aerodynamic shell are formed as a single molded piece made from at least one of a natural resin material, a synthetic resin material, and a plastic material.

9. A crew shell fairing according to claim 7, wherein said at least one mounting member is one of a Velcro® fastener and a Dual-Lock® fastener, which is connectable with corresponding mating pieces attached to a top surface of the crew shell.

10. A crew shell fairing according to claim 7, wherein, when said crew shell fairing is mounted on the crew shell, said crew shell fairing is disposed on a top surface of the crew shell between a bow of the crew shell and a bowman position of the crew shell with said end surface being disposed towards a stern of the crew shell, and a closed end of said U-shaped bottom surface being disposed towards the bow of the crew shell.

11. A crew shell fairing according to claim 7, wherein said end surface is one of a substantially open surface and a closed surface.

12. A crew shell fairing according to claim 7, wherein said aerodynamic shell sweeps through said angle between said end surface and said bottom surface.

13. A crew shell fairing removably mountable onto a crew shell, said crew shell fairing comprising:

a substantially U-shaped end surface having an end surface outer edge;

a substantially U-shaped bottom surface having a bottom surface outer edge;

an aerodynamic shell having a substantially convex outer surface extending between said end surface outer edge and said bottom surface outer edge; and at least one mounting member disposed on said bottom surface and removably connected to the crew shell when said crew shell fairing is mounted on the crew shell, wherein an angle between said end surface and said bottom surface is less than 90 degrees, and wherein said end surface is wider adjacent a closed end of the U-shape of said end surface than at an open end of the U-shape of said end surface.

14. A crew shell fairing according to claim 13, wherein said end surface, said bottom surface, and said aerodynamic shell are formed as a single molded piece made from at least one of a natural resin material, a synthetic resin material, and a plastic material.

15. A crew shell fairing according to claim 13, wherein said at least one mounting member is one of a Velcro® fastener and a Dual-Lock® fastener, which is connectable with corresponding mating pieces attached to a top surface of the crew shell.

16. A crew shell fairing according to claim 13, wherein, when said crew shell fairing is mounted on the crew shell, said crew shell fairing is disposed on a top surface of the crew shell between a bow of the crew shell and a bowman position of the crew shell with said end surface being disposed towards a stern of the crew shell, and a closed end of said U-shaped bottom surface being disposed towards the bow of the crew shell.

17. A crew shell fairing according to claim 13, wherein said end surface is one of a substantially open surface and a closed surface.

18. A crew shell fairing according to claim 13, wherein said aerodynamic shell sweeps through said angle between said end surface and said bottom surface.

* * * * *